US007226521B2

(12) United States Patent
Steinhardt et al.

(10) Patent No.: US 7,226,521 B2
(45) Date of Patent: Jun. 5, 2007

(54) LAMINAE SEPARATING DISPENSER AND METHOD OF USE

(75) Inventors: Mark John Steinhardt, Cincinnati, OH (US); Chow-Chi Huang, West Chester, OH (US); Michael Bernard Dugas, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/980,215

(22) Filed: Nov. 3, 2004

(65) Prior Publication Data

US 2006/0090843 A1 May 4, 2006

(51) Int. Cl.
*B32B 37/18* (2006.01)
*B32B 38/10* (2006.01)

(52) U.S. Cl. ..... 156/249; 156/344; 156/574; 156/577; 156/584

(58) Field of Classification Search ..... 156/574, 156/577, 579, 344, 584, 247, 249; 225/28, 225/56; 206/411; 271/280, 281, 285
See application file for complete search history.

(56) References Cited

U.S. PATENT DOCUMENTS

| | | | | | |
|---|---|---|---|---|---|
| 2,337,724 | A | * | 12/1943 | Mackie | 156/584 |
| 2,731,263 | A | | 1/1956 | Baril, Jr. et al. | |
| 3,026,239 | A | * | 3/1962 | Porter | 156/584 |
| 3,111,872 | A | | 11/1963 | Trippler | |
| 3,468,743 | A | * | 9/1969 | Soriano | 156/584 |
| 3,477,896 | A | | 11/1969 | Townsend et al. | |
| 3,700,151 | A | * | 10/1972 | Youngstrom | 225/26 |
| 3,743,086 | A | | 7/1973 | Aldrich | |
| 3,907,628 | A | | 9/1975 | Buske et al. | |
| 3,964,095 | A | * | 6/1976 | Kihara et al. | 360/81 |
| 4,521,785 | A | | 6/1985 | Matsufuji | |
| 4,806,184 | A | | 2/1989 | Shannon | |
| 5,000,815 | A | * | 3/1991 | Hanna | 156/542 |
| 5,141,584 | A | | 8/1992 | Schuh et al. | |
| 5,169,474 | A | | 12/1992 | Binder | |
| 5,328,547 | A | * | 7/1994 | Boldrini et al. | 156/584 |
| 5,352,466 | A | | 10/1994 | Delonis | |
| 5,466,324 | A | * | 11/1995 | Mailloux | 156/344 |
| 5,498,305 | A | | 3/1996 | Mailloux | |
| 5,861,077 | A | | 1/1999 | Kamijo et al. | |
| 5,897,742 | A | | 4/1999 | Semmler | |
| 5,941,413 | A | * | 8/1999 | Roman | 221/73 |
| 5,954,257 | A | | 9/1999 | Panneri et al. | |
| D428,922 | S | | 8/2000 | Packard et al. | |
| 6,152,398 | A | | 11/2000 | Chen | |
| D448,416 | S | | 9/2001 | Kimura | |

(Continued)

OTHER PUBLICATIONS

PCT International Search Report, mailed Mar. 21, 2006, 5 pages.

*Primary Examiner*—Mark A Osele
(74) *Attorney, Agent, or Firm*—Larry L. Huston; Jeffrey V. Bamber

(57) ABSTRACT

A method and apparatus for separating two laminae of a laminate. The apparatus has a separator extending into the path of the laminate as it travels through the apparatus. The separator may be shaped similar to a knife blade and be interposed between the two laminae of the laminate as the laminae pass by the separator. At least a portion of the laminae of the laminate are separated from one another by the separator during dispensing.

17 Claims, 3 Drawing Sheets

U.S. PATENT DOCUMENTS

| | | | | |
|---|---|---|---|---|
| 6,296,033 | B1 | 10/2001 | Clements | |
| 6,336,491 | B1 | 1/2002 | Sakamoto | |
| 6,394,165 | B1 | 5/2002 | Rader | |
| 6,481,485 | B1 | 11/2002 | Herrmannsen et al. | |
| 6,491,082 | B1 | 12/2002 | Fu | |
| 6,493,918 | B1 | 12/2002 | Bell et al. | |
| 6,499,524 | B1 | 12/2002 | Miller et al. | |
| 6,554,044 | B2 | 4/2003 | Paulson et al. | |
| 6,601,631 | B1 | 8/2003 | Miller et al. | |
| 6,684,924 | B1 | 2/2004 | Kelders et al. | |
| 6,685,795 | B1 * | 2/2004 | Braun | 156/344 |
| 6,725,753 | B2 | 4/2004 | Bell | |
| 6,740,379 | B1 | 5/2004 | Congard et al. | |
| 6,874,554 | B2 | 4/2005 | Chandaria | |
| 6,908,007 | B2 | 6/2005 | Hrdlicka | |
| 6,913,060 | B2 | 7/2005 | Chandaria | |
| 6,971,431 | B2 | 12/2005 | Steinberger | |
| 2002/0170918 | A1 | 11/2002 | Solovay et al. | |
| 2003/0071051 | A1 * | 4/2003 | Martinsen | 221/70 |
| 2003/0154569 | A1 | 8/2003 | McKay | |
| 2004/0040670 | A1 | 3/2004 | Chandaria | |
| 2004/0126529 | A1 | 7/2004 | Squier et al. | |

* cited by examiner

LAMINAE SEPARATING DISPENSER AND METHOD OF USE

FIELD OF THE INVENTION

This invention relates to laminates, and more particularly to an apparatus and method of separating plural laminae of a laminate.

BACKGROUND OF THE INVENTION

Dispensers for sheet materials are well known in the art. Exemplary dispensers are disclosed in U.S. Publication No. 2004/0040670 A1, pub. Mar. 4, 2004 in the name of Chandaria, U.S. Pat. No. 4,806,184, iss. Feb. 21, 1989 to Shannon and U.S. Pat. No. 3,743,086, iss. Jul. 3, 1973 to Aldrich.

Sheets and laminates may be tabbed to provide easy manipulation by the user, as illustrated by U.S. Publication No. 2003/0154569 A1, pub. Aug. 21, 2003 in the name of McKay and U.S. Pat. No. 5,352,466, iss. Oct. 4, 1994 to Delonis.

Yet other attempts in the art teach delamination of plural laminae of a laminate. Exemplary art includes U.S. Pat. No. 5,141,584, iss. Aug. 25, 1992 to Schuh et al.; U.S. Pat. No. 5,498,305, iss. Mar. 12, 1996 to Mailloux; U.S. Pat. No. 6,740,379 B1, iss. May 25, 2004 to Congard et al.; and U.S. Publication No. 2004/0126529 A1, pub. Jul. 1, 2004 in the name of Squier et al.

However, the art fails to teach a convenient dispensing apparatus which also provides for separation of laminae of a laminate. Such laminates include materials used for application of functional or aesthetic benefits to walls and other surfaces such as dry paint, architectural surfaces, wallpaper, decals, stickers, labels, faux covers usable for windows, floors, countertops, furniture and other uses, etc., where such separation may be desirable.

SUMMARY OF THE INVENTION

The invention comprises an apparatus for dispensing a laminate. The laminate has at least two laminae joined in face-to-face relationship. The apparatus comprises a frame and defines a dispensing path through which a laminate may travel. The apparatus may have an outlet through which a laminate may be dispensed. The apparatus further comprises a separator disposed in the dispensing path. At least one end of the separator is joined to the frame and extends outwardly therefrom. The separator intercepts the laminate to separate at least a first portion of the first lamina from at least a first portion of the second lamina. Separation may occur during dispensing.

In another embodiment, the invention may comprise a kit. The kit may comprise the dispensing apparatus and one or more laminates suitable for use with the dispensing apparatus.

In another embodiment, the invention may comprise a method for dispensing a laminate. The method comprises the steps of moving a laminate through or relative to a dispensing path in the apparatus, and interposing the separator of the apparatus between adjacent laminae of the laminate, so that at least one lamina passes on each side of the separator. At least a portion of the laminae are separated from each other at a position corresponding to the separator during dispensing.

DETAILED DESCRIPTION OF THE INVENTION

Figure 1:
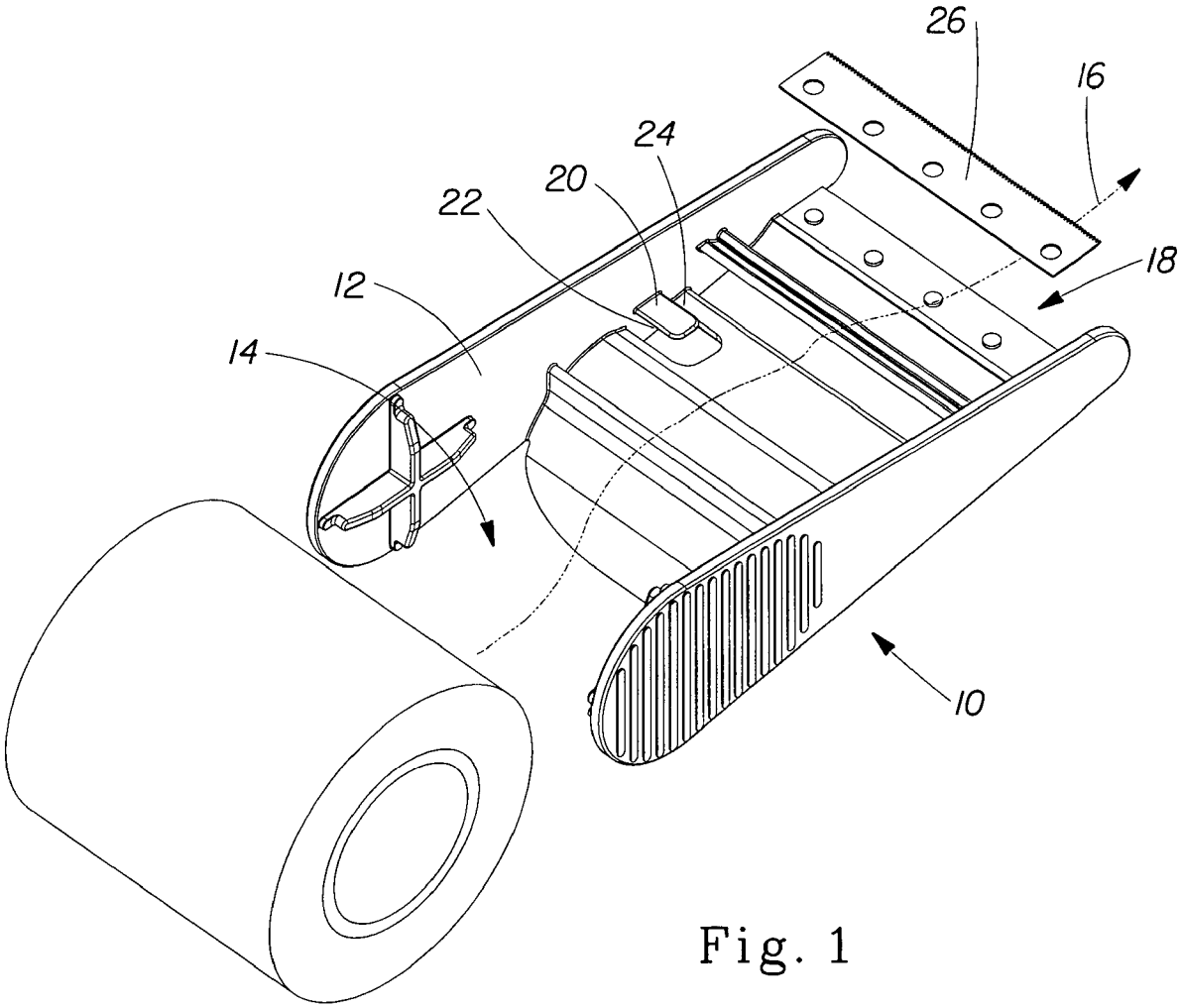
FIG. 1 is an exploded perspective view of an apparatus according to the present invention.
Figure 2:
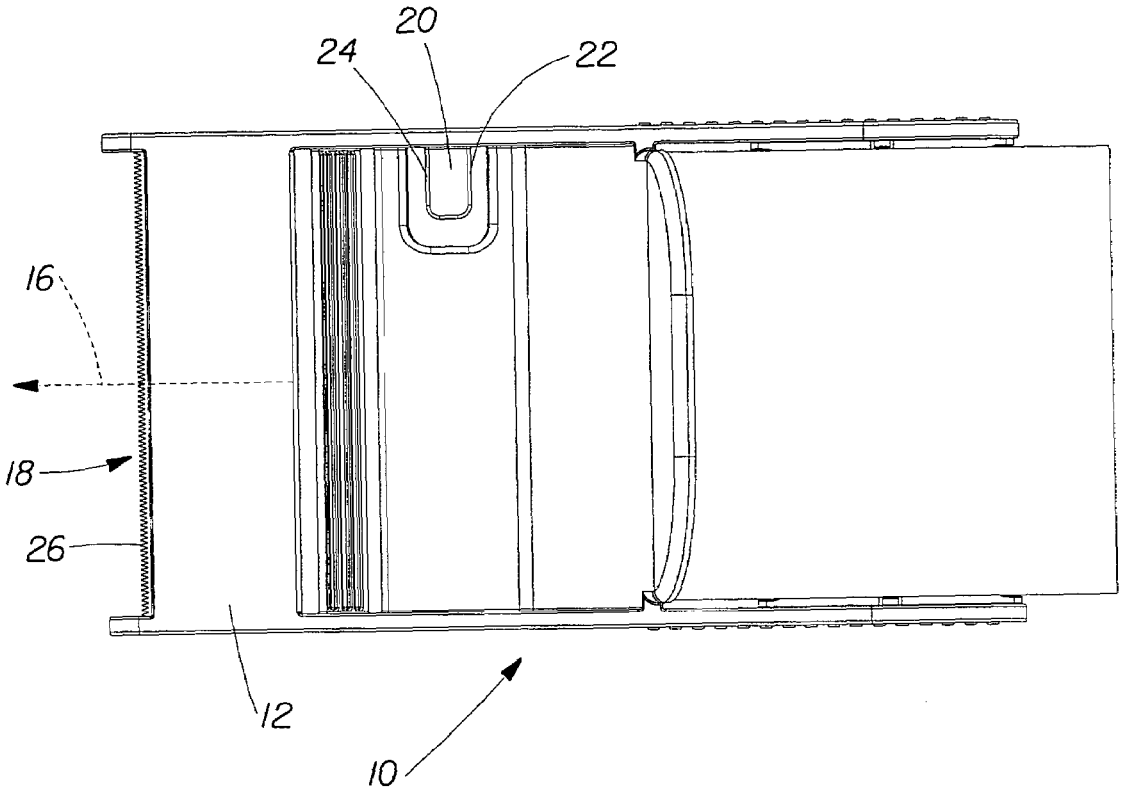
FIG. 2 is a top plan view of FIG. 1

Referring to FIGS. 1–2, the invention comprises an apparatus 10 for dispensing a laminate. The apparatus 10 comprises a frame 12 which may be integral with the walls of the apparatus 10 and optionally a reservoir 14 for holding a supply of the laminate. Alternatively, the supply of the laminate may be disposed remote from the apparatus 10 and fed into and through the apparatus 10.

Feeding and travel of the laminate through the apparatus 10 occurs along a dispensing path 16, which is the path the laminate travels from the point of supply or entry into the apparatus 10 to the point of dispensing from the apparatus 10. Dispensing may occur through an outlet 18 which may define the point at which the laminate leaves the apparatus 10 and is terminus of the dispensing path 16. Disposed in the dispensing path 16 is a separator 20.

A laminate usable with the present invention comprises two or more laminae joined in face-to-face relationship. The laminae may comprise the same or different materials, calipers, flexibilities, widths, etc. At least a portion of one lamina may be separated from a corresponding portion of an adjacent lamina without tearing or undue damage. The laminae of the laminate are typically separated along one or both edges of the laminate, which edges are oppositely disposed across the width of the laminate.

The laminate may be provided in sheet form, wound onto a roll, provided as discrete units and be of determinate or indeterminate length. The length of the laminate is taken parallel to the dispensing path 16 of the apparatus 10. The laminate has a width taken parallel to the width of the dispensing path 16 of the apparatus 10. The laminate may be of any width suitable for its intended use. The laminae may be of constant or variable thickness and/or material properties. An exemplary nonlimiting laminate usable with the present invention may have a thickness of less than or equal to 0.13 millimeters, and even less than or equal to 0.6 millimeters. Each laminae of the laminate may have a thickness of less than or equal to 0.4 millimeters, and even less than or equal to 0.3 millimeters. The flexibility of the laminate may be measured according to ASTM D2923, measuring each sample on the same side of the laminate, using a Thwing-Albert Handleometer, Model 211-300, with a gap of 10 millimeters and a light dusting of powder on the platform. Each sample tested had dimensions of 20.32 centimeters×20.32 centimeters. A laminate usable with the present invention may have a flexibility of less than 10, if desired, less than 5, if desired, less than 4, and if further desired, less than 3 grams per centimeter.

An exemplary laminate had the properties set forth in Table I below.

TABLE I

| MD (g) | CD (g) | Thickness (mm) |
|---|---|---|
| | Laminate | |
| 46.4 | 48.5 | 0.058 |
| 57.9 | 60.9 | 0.064 |
| 38.8 | 44.6 | 0.053 |
| | First Lamina | |
| 26.1 | 25.8 | 0.002 |
| 24.7 | 25.6 | 0.028 |
| 26.3 | 30.6 | 0.024 |
| | Second Lamina | |
| 8.1 | 8.5 | 0.036 |
| 10.8 | 10.5 | 0.041 |
| 4.5 | 4.2 | 0.028 |

If three or more laminae are joined together to make a single laminate, any two adjacent laminae may be at least partially separated according to the apparatus 10 and method of the present invention. In a three-laminae laminate, such separation would leave a single lamina and two laminae joined together. Alternatively, multiple separators 20 may be used with a laminate having three or more laminae, so that each of the laminae are separated from an adjacent lamina and/or alternatively, certain laminae may remain joined together as desired.

The inlet, dispensing outlet 18, and frame 12 of the apparatus 10 are known in the art and will not be described in further detail herein. Generally, any arrangement and geometry suitable for the volume of desired laminate reservoir 14, laminate width and which accommodates a dispensing path 16 adequate for the flexibility and other material properties of the laminate will suffice. Optionally, the apparatus 10 may include a blade suitable for cutting the laminate to a desired length.

The separator 20 may be joined to the frame 12 of the applicator, a wall of the applicator, or any other appendage or suitable portion of the applicator. All such portions of the applicator are ultimately joined or connected, directly or indirectly, to the frame 12 of the applicator and, therefore accordingly, as described and used hereunder, the separator 20 is considered to be joined to the frame 12 of the applicator.

As illustrated in FIGS. 1–2, the separator 20 may be cantilevered. In such an arrangement, the separator 20 has a first or proximal end joined to the frame 12 as described above, and a second or distal end extending outwardly therefrom and into the dispensing path 16. The separator 20 has a length taken in the direction of the dispensing path 16 and a width taken perpendicular thereto and parallel to the width of the laminate.

The separator 20 may have a width to length ratio ranging from about 1:1 to about 4:1 and particularly about 2:1 to about 3:1. For the embodiments described and claimed herein, such a ratio is believed sufficient to generally keep the separator 20 from twisting under the load of ordinary dispensing. For the embodiments described and claimed herein, the separator 20 may have a width of 6 to 13 millimeters. The desired geometry will depend upon how well the laminate can support itself during dispensing, the visibility of the separated portion of the laminate upon dispensing and the ease with which the laminae separate from one another during dispensing.

The separator 20 may be made of steel, or other suitably rigid material and have any desired thickness. The separator 20 has a leading edge 22 which is the edge first intercepted by the laminate as it traverses the dispensing path 16 and a trailing edge 24 downstream therefrom and opposed thereto. The separator 20 preferably intercepts at least one edge of the laminate.

Preferably, the separator 20 may be planar and/or flat and has a thickness which is relatively small compared to the length and width dimensions of the separator 20. This arrangement provides the benefit that the separator 20 causes less disturbance to the laminate during separation. To begin dispensing, one may take the laminate and manually intercept it with the separator 20. This arrangement allows the user to control the start of the separation process and prevent tearing or undue disturbance to the laminate.

Alternatively, the separator 20 may have a round cross section and specifically may be generally cylindrically-shaped. This geometry provides the benefit that the leading edge 22 of the separator 20 intercepts the laminate at a tangent point and diverges so that the adjacent laminae are separated by the laminate. If desired, such a separator 20 may be axially rotatable.

If desired, the separator 20 may be biased towards one side, i.e., into one or the other of the laminae contacting the separator 20 during dispensing. If a biased separator 20 is desired, the separator 20 may be biased towards the stronger lamina of the laminae in contact with the separator 20 during dispensing. The separator 20 may also function as a guide to keep the laminate properly positioned in the dispensing path 16. Biasing may be accomplished by using a rib to bias the laminate towards one side of the dispensing path 16. Generally, if multiple guides or biasing means are utilized, the biasing means against the weaker lamina should be downstream of the other biasing means.

In any case, the apparatus 10 may be manually operated and may not require a power source to operate. Further, the apparatus 10 does not require specific tracks or channels to guide the laminate through the dispensing path 16.

The separator 20 preferably extends into the width of the laminate from the edge a distance sufficient to allow separation of the laminae to any desired amount, depending upon the ultimate use of and materials selected for the laminae. If desired, the separator 20 may extend into the width of the laminate a distance comprising about 10 to 50, or 20 to 33 percent of the width of the laminate. If the separator 20 extends too far into the width of the laminate, individual laminae may buckle or fold after separation. If the separator 20 does not extend far enough, adequate separation of the laminae may not occur.

The leading edge 22 of the separator 20 may be disposed perpendicular to the dispensing path 16. Alternatively, the leading edge 22 of the separator 20 may be disposed in nonperpendicular angular relationship with the dispensing path 16. If such a geometry is desired, the proximal end of the leading edge 22 of the separator 20 may be disposed upstream of the distal end of that separator 20. However, the leading edge 22 of the separator 20 should not form an angle which is too great (too obtuse) relative to the dispensing direction, otherwise the laminate may wander off the separator 20 during dispensing, preventing separation of the laminae from occurring. The leading edge 22 of the separator 20 may be arcuate, particularly convexly arcuate, or straight, as desired.

The distal end of the separator 20 should not be disposed upstream of the proximal end of the separator 20. Such an arrangement may allow the distal end of the separator 20 to rip or cause undue damage to the laminate during dispensing. Likewise, the distal end of the separator 20 should not taper to an excessively sharp point, or undesired tearing of the laminate may occur during dispensing.

The separator 20 may be generally wedge-shaped, approximating a foil, tab or blade in geometry and cross-section. If so, the separator 20 may divergently taper from the leading edge 22 toward the trailing edge 24. Furthermore, the separator 20 may divergently taper with a variable cross-section. In such an embodiment, the proximal end of the separator 20 may be thicker, taken perpendicular to the plane of the dispensing path 16, than the distal end of the separator 20.

If desired, the apparatus 10 may have plural separators 20 of the type shown in FIGS. 1–2. For example, two or more separators 20 may be juxtaposed with a common edge of the laminate. In such an arrangement, the separators 20 may be stacked so that a laminate having three or more laminae may be separated into individual laminae. If only a single separator 20 is used in a three-laminae laminate, one of skill will recognize that separation will yield an arrangement having two laminae joined together and separated from a single lamina.

If stacked separators 20 are desired, the stacked separators 20 may be staggered in the direction of the dispensing path 16 or may have a common position and geometry in the dispensing path 16. Furthermore, if plural separators 20 are utilized, the separators 20 may be of mutually different lengths, widths, thicknesses, etc.

Alternatively, if desired, plural separators 20 may be utilized and arranged so that one or more separators 20 is/are juxtaposed with each edge of the laminate. This arrangement provides the benefit that both edges of the laminae are separated and can be later utilized as desired. Additionally, if both edges of the laminae are separated, the laminate will typically have minimal camber and provide for more accurate tracking during dispensing.

Of course, one will recognize that multiple combinations are possible. For example, plural separators 20 may be used at each edge of the laminate. If so, the separators 20 may be symmetrically or asymmetrically arranged as to position, geometry, number, etc.

Figure 3:
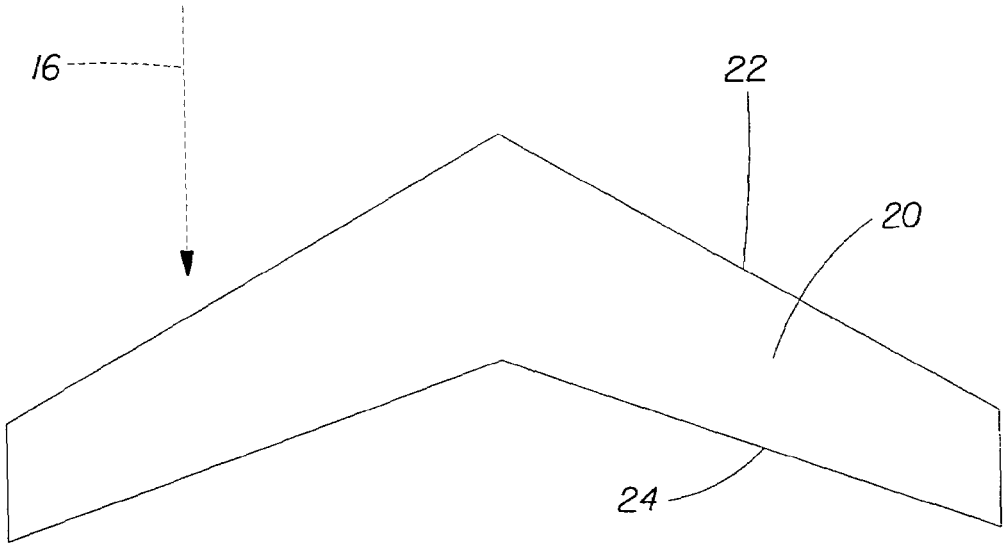
FIG. 3 is a top plan view of an alternative embodiment of a separator usable with the present invention, suitable for being fixed at both ends of the separator.

Referring to FIG. 3, if desired, one or more separators 20 may extend entirely across the width of the dispensing path 16, and thus substantially or entirely throughout the width of the laminate. Such a separator 20 may be cantilevered or, alternatively, may be joined to the frame 12 at each end and/or at positions intermediate the ends.

Such a separator 20 may be arcuately-shaped, chevron-shaped or, alternatively of constant length, taken in the direction parallel to the dispensing path 16. Such a separator 20 may be of constant or variable cross-section. If a separator 20 of variable cross-section is selected, the thickness of the separator 20 may be greater at one or both edges than at the centerline of the dispensing path 16. Furthermore, the separator 20 may be symmetric or asymmetric about the centerline of the dispensing path 16.

Figure 4:
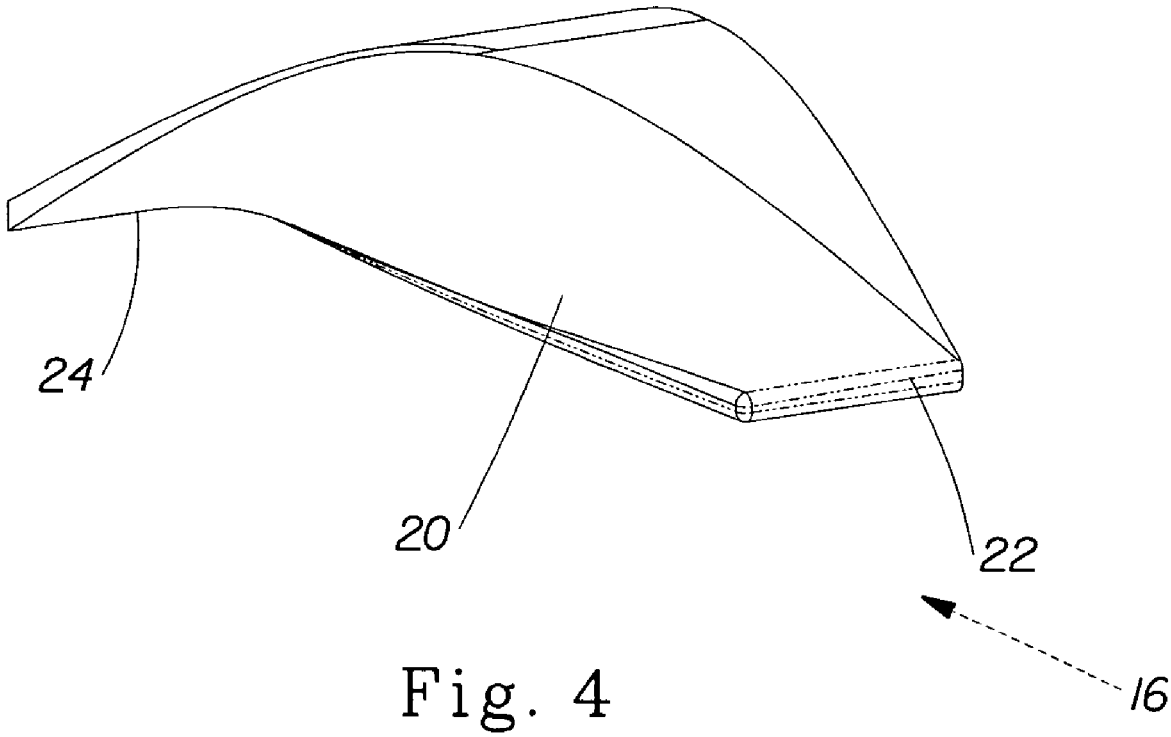
FIG. 4 is a perspective view of an alternative embodiment of a separator usable with the present invention and which may fold the edge of a lamina after separation

Referring to FIG. 4, if desired, the separator 20 may be generally nonplanar. In this arrangement, the separator 20 acts as a plow, not only releasing at least a portion of the first lamina from the second lamina, but also peeling at least a portion of the first and second laminae away from each other. This arrangement provides the benefit that one of the laminae is more easily grasped and ready for use.

If desired, the separator 20 may further be utilized as a folding plow to fold, roll or crease one or more of the laminae. This arrangement provides the benefit that after separation, the laminae are folded, rolled or otherwise configured into a generally nonplanar configuration.

Such a separator 20 may be arcuately-shaped similar to a plow. The separator 20 has a proximal end which intercepts the edge of the laminate. The distal end of the separator 20 is located out of the plane of the laminate, relative to the proximal end. This arrangement provides for a gradual transition of the laminae as they separate from one another.

Upon using such an embodiment, the edge of the first lamina and the edge of the second lamina may be mutually spaced apart following separation, rather than simply laying one on top of another without being joined together. This provides the benefit it may be easier for the user to grasp that edge of the laminate to facilitate further removal from an adjacent lamina.

In operation, the apparatus 10 is provided. Also provided is a clip, magazine, roll or other quantity of laminate material. The laminate may be disposed in a reservoir 14, which reservoir 14 may be internal to or external to the frame 12 of the apparatus 10. The laminate is threaded along the dispensing path 16 from the reservoir 14 of laminate material to one or more separators 20. At the separator(s) 20, the user may grasp the laminate such that one or more of the separator(s) 20 are interposed between adjacent laminae. The laminate may continue past the separator 20, along the dispensing path 16 to the outlet 18 of the apparatus 10. At the outlet 18, the laminate exits the apparatus 10 for application to a substrate or other use as desired. Upon, or prior to, application of the laminate to the substrate or other desired use of the laminate, the laminae may be completely separated from one another. The laminate may be adhesively joined to a substrate.

If desired, the apparatus 10 may have a blade 26 to sever the laminate, or an individual lamina during dispensing. The blade 26 may extend across the width of the dispensing path 16. Alternatively, the blade 26 may be of lesser width and only partially sever the laminate, as desired.

If desired, the apparatus 10 may be provided with teeth biased against the dispensing direction and which may engage the laminate. The teeth prevent the laminate from backtracking or re-entering the apparatus 10 during the dispensing process. Alternatively or additionally, the apparatus 10 may be provided with means to tenter, stretch, or apply zone treatments to the laminate during dispensing. This may be accomplished by deforming the laminate out of its plane during dispensing or stretching the laminate through ring rollers. If any such zone treatments are applied to the laminate during dispensing, a single or plural zone treatments may occur. Zone treatments may be of equal or unequal width, type of treatment, degree of treatment, etc.

If desired, the apparatus 10 and laminate may be provided as a kit. The kit may comprise a single apparatus 10, or two or more apparatuses 10. Additionally, the kit may comprise plural laminates. The laminates may be the same, or at least two of the laminates may be mutually different.

This type of kit provides the advantage that a single apparatus 10 can be sold with and used to dispense multiple laminates. For example, the user may desire the apparatus 10 to dispense a first laminate having a first color or other functionality. The user then may desire the apparatus 10 dispense a second laminate having the same, or likely different, color, functionality, etc.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for dispensing a laminate comprising at least first and second laminae joined in face-to-face relationship, said apparatus comprising:

a frame defining a dispensing path through which a laminate may travel;

an outlet for dispensing a laminate therethrough; and a separator, said separator being disposed in the dispensing path and having at least one proximal end joined to said frame of said apparatus and extending outwardly therefrom to a distal end whereby said separator can intercept a laminate in said dispensing path to separate at least a portion of said first lamina from at least a portion of said second lamina while the laminate is being dispensed from said apparatus, wherein said separator is generally planar and cantilevered from said frame of said apparatus wherein said separator has a leading edge and a trailing edge opposed thereto, said leading edge intercepting the laminate during dispensing, said leading edge being disposed substantially perpendicular to said dispensing path, wherein said separator has a length and a width, said length being taken parallel to said dispensing path and said width being taken parallel to the width of said dispensing path, said width of said separator being greater than said length of said separator, and wherein said separator has a cross-section, and said cross-section of said separator becomes smaller as said distal end is approached.

2. An apparatus according to claim 1 wherein said separator extends into the width of the laminate a distance of about 10 to 50 percent of the width of said laminate.

3. An apparatus according to claim 2 wherein said frame has two opposed sides on opposite sides of said dispensing path, and said apparatus comprises a single separator, wherein said separator is joined to only one side of the frame.

4. An apparatus according to claim 3, wherein said separator has a non-constant cross-section.

5. A method of dispensing a laminate, said laminate having a pair of opposed edges and a width between said edges, said method comprising the steps of:

providing a dispensing apparatus, said dispensing apparatus having a dispensing path through which said laminate is dispensed, said dispensing apparatus having a separator therein, said separator having a first side and a second side opposed thereto;

providing a laminate to be dispensed, said laminate having first and second laminae;

inserting at least a portion of said laminate into said apparatus, whereby said laminate can progress alone said dispensing path;

leading said laminate through said dispensing path until said laminate intercepts said separator;

interposing said separator between adjacent laminae of the laminate, whereby a first lamina of said laminate passes on said first side of said separator and a second lamina of said laminate passes on said second side of said separator as dispensing continues alone said dispensing path; and separating a portion of said first lamina from a portion of said second lamina along only one of the edges of the laminate and across only a portion of the width of the laminate while said laminae are being dispensed from said apparatus, whereby said portion of said first lamina separated from said portion of said second lamina comprises a finite and generally constant separation width, said method further comprising the steps of:

applying said laminate to a substrate, whereby said first lamina is in contacting relationship with said substrate; and removing said second lamina from said first lamina while said first lamina is in contact with said substrate.

6. A method of dispensing a laminate, said laminate having a pair of opposed edges and a width between said edges, said method comprising the steps of:

providing a dispensing apparatus, said dispensing apparatus having a dispensing path through which said laminate is dispensed, said dispensing apparatus having a separator therein, said separator having a first side and a second side opposed thereto, and being arcuate and nonplanar;

providing a laminate to be dispensed, said laminate having first and second laminae;

inserting at least a portion of said laminate into said apparatus, whereby said laminate can progress along said dispensing path;

leading said laminate through said dispensing path until said laminate intercepts said separator;

interposing said separator between adjacent laminae of the laminate, whereby a first lamina of said laminate passes on said first side of said separator and a second lamina of said laminate passes on said second side of said separator as dispensing continues along said dispensing path;

separating a portion of said first lamina from a portion of said second lamina alone only one of the edges of the laminate and across only a portion of the width of the laminate while said laminae are being dispensed from said apparatus, wherein said separator lifts a portion of said first lamina from a corresponding portion of said second lamina at a common edge thereof so that an edge of said first lamina is spaced apart from the corresponding edge of said second lamina; and grasping said edge of said first lamina which has been separated from said edge of said second lamina to remove said first lamina from said second lamina.

7. A method of dispensing a laminate, said laminate having a pair of opposed edges and a width between said edges, said method comprising the steps of:

providing a dispensing apparatus, said dispensing apparatus having a dispensing path through which said laminate is dispensed, said dispensing apparatus having a separator therein, said separator having a first side and a second side opposed thereto;

providing a laminate to be dispensed, said laminate having first and second laminae;

inserting at least a portion of said laminate into said apparatus, whereby said laminate can progress alone said dispensing path;

leading said laminate through said dispensing path until said laminate intercepts said separator;

manually interposing said separator between adjacent laminae of the laminate, whereby a first lamina of said laminate passes on said first side of said separator and a second lamina of said laminate passes on said second side of said separator as dispensing continues alone said dispensing path; and separating a portion of said first lamina from a portion of said second lamina along only one of the edges of the laminate and across only a portion of the width of the laminate while said laminae are being dispensed from said apparatus.

8. A method according to claim 7, further comprising the step of manually dispensing said laminate from said apparatus.

9. A kit comprising an apparatus and at least one laminate, said laminate having a pair of opposed edges and a width between said edges, said apparatus comprising:

a frame defining a dispensing path through which a laminate may travel;

an outlet for dispensing a laminate therethrough; and a separator, said separator being disposed in the dispensing path and having at least one end joined to said frame of said apparatus and extending outwardly therefrom whereby said separator is configured to intercept a laminate in said dispensing path and to separate a portion of said first lamina from a portion of said second lamina along only one of the edges of the laminate and across only a portion of the width of the laminate while the laminate is being dispensed from said apparatus; and a laminate, said laminate being usable with and dispensable from said apparatus.

10. A kit according to claim 9, wherein said laminate has a flexibility of less than 10 grams per centimeter.

11. A kit according to claim 9, comprising a single dispensing apparatus and plural laminates.

12. A kit according to claim 11, wherein at least two of said laminates are mutually different.

13. A kit according to claim 9 wherein said separator is generally planar and cantilevered from said frame of said apparatus.

14. A kit according to claim 9 wherein said separator has a leading edge and a trailing edge opposed thereto, said leading edge intercepting the laminate during dispensing, said leading edge being disposed substantially perpendicular to said dispensing path.

15. A kit according to claim 9 wherein said separator has a length and a width, said length being taken parallel to said dispensing path and said width being taken parallel to the width of said dispensing path, said width of said separator being greater than said length of said separator.

16. A kit according to claim 9 wherein said separator extends into the width of the laminate a distance of about 10 to 50 percent of the width of said laminate.

17. A kit according to claim 9 wherein said frame has two opposed sides on opposite sides of said dispensing path, and said apparatus comprises a single separator, wherein said separator is joined to only one side of the frame.

* * * * *